US009670740B2

(12) United States Patent
Hallai et al.

(10) Patent No.: US 9,670,740 B2
(45) Date of Patent: Jun. 6, 2017

(54) DRILLING RISER WITH DISTRIBUTED BUOYANCY

(71) Applicants: Julian de Freitas Hallai, Spring, TX (US); Daniel M. Fenz, Houston, TX (US)

(72) Inventors: Julian de Freitas Hallai, Spring, TX (US); Daniel M. Fenz, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/016,496

(22) Filed: Feb. 5, 2016

(65) Prior Publication Data

US 2016/0251911 A1 Sep. 1, 2016

Related U.S. Application Data

(60) Provisional application No. 62/121,065, filed on Feb. 26, 2015, provisional application No. 62/270,326, filed on Dec. 21, 2015.

(51) Int. Cl.
*E21B 17/01* (2006.01)
*E21B 19/00* (2006.01)

(52) U.S. Cl.
CPC ..... *E21B 17/012* (2013.01); *E21B 19/004* (2013.01)

(58) Field of Classification Search
CPC ..... E21B 17/012; E21B 19/004
See application file for complete search history.

(56) References Cited

U.S. PATENT DOCUMENTS 3,999,617 A 12/1976 Ilfrey et al.
4,098,333 A * 7/1978 Wells ..... E21B 17/012 166/352
4,234,047 A 11/1980 Mott
4,436,451 A * 3/1984 Anderson ..... B63B 21/50 166/355
4,646,840 A 3/1987 Bartholomew et al.
5,046,896 A 9/1991 Cole
5,439,321 A * 8/1995 Hunter ..... B63B 21/502 166/350
5,657,823 A 8/1997 Kogure et al.
5,676,209 A 10/1997 Reynolds
7,628,665 B1 12/2009 Cook et al.
8,047,297 B2 11/2011 Millheim et al.
8,960,304 B2 * 2/2015 Luppi ..... E21B 17/015 166/345

(Continued)

OTHER PUBLICATIONS

CoreTec™ Drilling Riser Buoyancy Modules, Flotation Technologies, Inc., 2 pgs. (Apr. 25, 2012).

*Primary Examiner* — Matthew R Buck
*Assistant Examiner* — Aaron Lembo
(74) *Attorney, Agent, or Firm* — ExxonMobil Upstream Research Company Law Dept.

(57) ABSTRACT

A drilling riser configured to convey drilling materials between a drilling vessel and a subsea wellhead. The drilling riser has an upper section, and a lower section coupled via a connector to the upper section. The lower section has a buoyant material for distributed passive buoyancy of the lower section. The overall drilling riser is neutrally or negatively buoyant, whereas the lower section is positively buoyant when decoupled from the upper section and coupled to the subsea wellhead.

26 Claims, 8 Drawing Sheets

(56) References Cited

U.S. PATENT DOCUMENTS

| | | | | |
|---|---|---|---|---|
| 9,068,398 | B2 * | 6/2015 | Van Petegem | B63B 25/28 |
| 2003/0000705 | A1 * | 1/2003 | Lenormand | E21B 17/012 166/346 |
| 2003/0026663 | A1 * | 2/2003 | Guesnon | E21B 17/01 405/224.2 |
| 2003/0143035 | A1 * | 7/2003 | Karayaka | B63B 43/00 405/224.2 |
| 2004/0129425 | A1 * | 7/2004 | Wilson | E21B 43/01 166/359 |
| 2006/0177276 | A1 * | 8/2006 | Stassen | E21B 17/012 405/224.3 |
| 2007/0044972 | A1 * | 3/2007 | Roveri | B63B 27/24 166/367 |
| 2008/0213048 | A1 | 9/2008 | Jones et al. | |
| 2009/0044950 | A1 | 2/2009 | Boudreau | |
| 2010/0018717 | A1 * | 1/2010 | Espinasse | E21B 17/012 166/346 |
| 2011/0286802 | A1 * | 11/2011 | Persson | F16L 1/24 405/170 |
| 2012/0273213 | A1 | 11/2012 | Blalock et al. | |
| 2014/0374117 | A1 | 12/2014 | Aune et al. | |

* cited by examiner

100

100A

114

100B

100C

100D

DRILLING RISER WITH DISTRIBUTED BUOYANCY

CROSS-REFERENCE TO RELATED APPLICATION

This application claims priority from both U.S. Provisional Patent Application No. 62/121,065, filed on Feb. 26, 2015, entitled Drilling Riser with Distributed Buoyancy and U.S. Provisional Patent Application No. 62/270,326 filed on Dec. 21, 2015 entitled Drilling Riser with Distributed Buoyancy, both of which are incorporated by reference herein in their entirety.

FIELD

The present techniques relate generally to subsea drilling and, more particularly, to a drilling riser with distributed buoyancy.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

A marine (subsea) drilling riser may be a conduit employed during drilling that provides an extension of a subsea oil well to a sea-surface drilling facility. For example, one end of the subsea drilling riser may interface with a subsea blowout preventer (BOP) at the wellhead, and the other end of the subsea drilling riser may interface with a floating drilling vessel at the sea level surface. Subsea drilling risers generally include a low-pressure main tube or conduit having a relatively large diameter and that conveys drilling materials, and in some cases, production fluids, between the drilling vessel and the well. The subsea drilling riser also has external auxiliary lines which may include a high pressure choke and lines for circulating fluids to the BOP. The auxiliary lines may also include power and control lines for the BOP. The design and operation of subsea drilling risers may be complex, and reliability may involve engineering analysis.

The marine (subsea) drilling riser may be tensioned for stability. A marine riser tensioner located on the drilling platform may provide a substantially constant tension force to maintain the stability of the riser in the offshore environment. The level of tension may be related to the weight of the riser equipment, the buoyancy of the riser, the forces from waves and currents, the weight of the internal fluids, and an allowance for equipment failures. To reduce the amount of tension to maintain stability of the riser, conventional buoyancy modules may be added to the riser joints to make the risers neutrally buoyant when submerged. An international standard ISO 13624-1:2009 covers design, selection, operation and maintenance of marine riser systems for floating drilling operations. The standard serves as a reference for designers, for those who select system components, and for those who use and maintain this equipment. The standard generally relies on basic engineering principles and the accumulated experience of offshore operators, contractors, and manufacturers. However, marine (subsea) drilling risers may also be designed, constructed, and maintained based on other standards or to general practice without reference to a particular standard.

The art employs concentrated buoyancy elements, at the top of the lower riser section, in the form of buoyancy cans, tanks, or inflatable bladders (such as in U.S. Pat. Nos. 4,234,047, 5,046,896, 5,657,823, and 5,676,209) or combinations of concentrated and dispersed buoyancy elements such as in U.S. Patent Publication No. 2009/0044950. Spread buoyancy employing actively controllable buoyancy via a plurality of gas-filled chambers is found in U.S. Pat. No. 4,646,840.

The stationkeeping capacity may be the capability of the surface drilling vessel to maintain its position relative to a reference point or to the subsea wellhead being drilled. In many subsea drilling scenarios, environmental conditions such as approaching storms or ice, have potential to impose loads on the drilling vessel in excess of the stationkeeping capacity. In such scenarios and other examples, the drilling operation may be stopped, the well shut-in, and the station keeping system disconnected from its anchors. The stationkeeping system including the drilling vessel may be relocated to an area or region on the sea remote from adverse environmental conditions. If so, a reduction in the time to suspend drilling operations, shut-in the well, and disconnect the stationkeeping system from the well may be beneficial. A significant time component may be the time to retrieve the drilling riser, particularly in deeper water depths. There is an on-going desire to improve shut down of drilling operations and the disconnection of the drilling vessel in impending adverse environmental conditions.

SUMMARY

An aspect of the present disclosure relates to a drilling riser having a conduit to convey drilling materials between a drilling vessel and a subsea wellhead, the drilling riser including an upper section and a lower section. The lower section is coupled via a connector to the upper section. The lower section includes a buoyant material for distributed passive buoyancy of the lower section, wherein the drilling riser is configured to be neutrally buoyant or negatively buoyant in operation, and wherein the lower section is configured to be positively buoyant and freestanding when decoupled from the upper section and coupled to the subsea wellhead.

Another aspect relates to a method of manufacturing a drilling riser for subsea drilling, the method including fabricating an upper section of the drilling riser, the upper section comprising an upper conduit for conveying drilling material; and fabricating a lower section of the drilling riser, the lower section comprising a lower conduit for conveying drilling material. The lower section is configured to couple via a connector to the upper section of the drilling riser. The method includes determining an amount of buoyant material to dispose on the lower section such that the lower section is positively buoyant and the drilling riser is neutrally or negatively buoyant in operation. The method also includes disposing the buoyant material on the lower section.

Yet another aspect relates to a method of operating a drilling riser, the method comprising conveying drilling material through a conduit of a lower section and a conduit of an upper section of the drilling riser, the lower section coupled to a subsea wellhead and the upper section coupled to a drilling vessel, wherein the drilling riser is neutrally or negatively buoyant. The method includes suspending drilling operations and shutting in the subsea wellhead, decoupling the upper section of the drilling riser from the lower section of the drilling riser, and relocating the drilling vessel and the upper section of the drilling riser. The lower section of the drilling riser coupled to the subsea wellhead is left in place, wherein the lower section comprises a buoyant material that is distributed and passive such that the lower section is positively buoyant.

DESCRIPTION OF THE DRAWINGS

The advantages of the present techniques are better understood by referring to the following detailed description and the attached drawings, in which:

FIG. 6 is a block diagram of an exemplary method of manufacturing a drilling riser with distributed passive buoyancy for a subsea drilling system; and.

DETAILED DESCRIPTION

Figure 1:
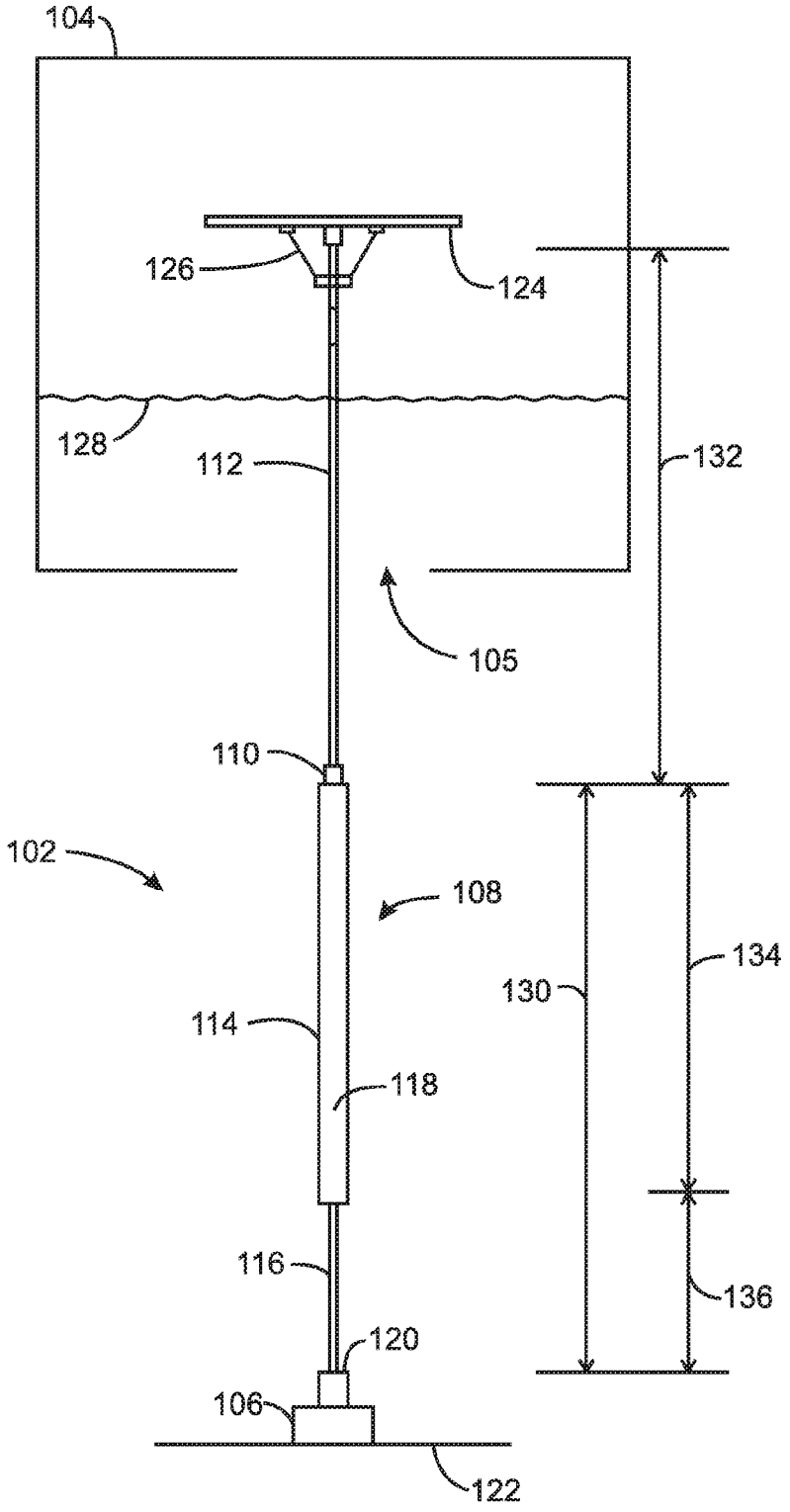
FIG. 1 is a diagram of an exemplary subsea drilling system having a drilling riser with passive buoyancy on a lower section of the drilling riser.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

As used herein, "substantially", "predominately" and other words of degree are relative modifiers intended to indicate permissible variation from the characteristic so modified. It is not intended to be limited to the absolute value or characteristic which it modifies, but rather possessing more of the physical or functional characteristic than its opposite, and preferably, approaching or approximating such a physical or functional characteristic.

"Exemplary" is used exclusively herein to mean "serving as an example, instance, or illustration." Any embodiment described herein as "exemplary" is not to be construed as preferred or advantageous over other embodiments.

To accommodate a more timely removal of a subsea drilling riser, embodiments of the present techniques include a drilling riser that is disconnected at an intermediate height along the drilling riser, leaving a freestanding lower portion of the drilling riser in place and coupled to the shut-down well. Embodiments employ distributed passive buoyancy on this lower portion of the drilling riser that can remain in place and be freestanding. Again, the decoupled and freestanding lower portion of the drilling riser can remain coupled to the shut-down well.

The buoyant material along this lower portion of the drilling riser provides for passive buoyancy in that the buoyancy is constant or substantially constant over time. The buoyant material may be distributed in the sense of generally continuous over part or all or the lower portion of the drilling riser. Of course, the distributed buoyancy may account for relatively small breaks, for example, at riser joint couplings. In operation, the distributed passive buoyancy can facilitate the lower section to be freestanding when disconnected from the upper portion of the riser, and thus disconnected from the drilling vessel and stationkeeping system. The passive feature of the buoyancy is in contrast to actively controllable buoyancy such as gas-filled chambers.

Drilling risers that may be disconnected at an intermediate location along the riser can provide for a reduced length of the riser to be pulled to decouple the drilling vessel from the well. Such systems employ a connector package that couples an upper portion of the riser with a lower portion of the riser at a chosen water depth. The connector package is used to disconnect the upper portion from the lower portion. The upper portion or upper riser section, i.e., the length of the riser above the connector, may be pulled and stored in the drilling vessel while the lower portion or lower riser section, i.e., the length of riser below the connector, is left in place, freestanding, after decoupling from the upper riser section and the drilling vessel. It should be noted that the stationkeeping system may also be relocated. On the other hand, the stationkeeping could be a mooring system, for example that would remain in place after the drilling vessel leaves the location.

In some systems, concentrated buoyancy at the top of the lower section may support the lower riser section such that the lower section does not collapse under its own weight when left freestanding. Such a supported freestanding lower section may be viewed conceptually, for example, as an inverted pendulum. These concentrated buoyancy approaches may employ active systems that can control how much buoyancy is provided at any given time and thus can increase or decrease the buoyancy as desired. In contrast, embodiments of the present techniques employ generally passive buoyancy as opposed to active buoyancy. Passive buoyancy can be beneficially less prone to failure, more simple to maintain, and more straightforward to repair or replace. Distributed buoyancy in contrast to concentrated buoyancy can be beneficially less prone to failure due to increased redundancy in distributed systems provided by multiple functional elements.

In general, conventional passive-like systems may include elements that provide a specific, generally non-changeable, amount of buoyancy. For instance, buoyancy joints reduce the total submerged weight of the drilling riser controlled by the buoyancy vessel. Such may give buoyancy to make the corresponding buoyant riser joints approximately neutrally buoyant. The buoyant material on these passively buoyant joints may typically be constructed of syntactic foam and provides a relatively constant amount of buoyancy to the riser. In contrast, while the embodiments of the passive buoyancy disclosed herein may use similar or different buoyant materials and provide a relatively constant amount of buoyancy, the buoyancy of the lower section of the subsea drilling riser is uniquely passively positively buoyant to be freestanding. This is in contrast to conventional systems having a focus on neutral buoyancy and a relatively smaller amount of buoyant material.

Some embodiments of the present techniques employ a distributed passive buoyancy to support the freestanding lower section of a riser. The distributed buoyancy may be provided by buoyancy elements attached to the riser. These buoyancy elements, however, provide generally much more buoyancy than in conventional drilling practice, in order to uniquely support the lower section of the riser in a free-standing mode.

This new distributed passive buoyancy over a substantial length of the lower section of the drilling riser provides for the lower section designed to be positively buoyant so that the lower section remains freestanding when disconnected from the upper section. However, the riser (including upper and lower riser sections), advantageously remains negatively or neutrally buoyant so that the riser (e.g., the entire riser) can be controlled by the tensioners of the drilling vessel, according to typical practice. These new beneficial features include (1) neutrally-buoyant or negatively-buoyant property of the riser when the upper section is connected to the lower section, and (2) positively-buoyant property of the lower section of the riser without the upper section. Such may be useful during operation of the drilling riser and subsequently during a planned or rapid shut-down and disconnection of the drilling riser at the mid-riser connector, with the drilling vessel abandoning location carrying the upper riser section, and with lower riser section remaining freestanding in-place coupled to the BOP at the subsea wellhead. In other examples, a rapid shut-down and disconnection of the drilling riser at the lower marine riser package (LMRP) at or near the BOP on the subsea wellhead may be implemented, with the drilling vessel abandoning location carrying the entire drilling riser. In such an instance, the drilling riser including any portion of the LMRP may still be neutrally or negatively buoyant such that the drilling riser in tow may be controlled via tensioners of the drilling vessel, for example.

As noted above, environmental conditions such as storms, ice, and other conditions, in subsea drilling may impose loads on the surface drilling vessel in excess of the stationkeeping capacity of the drilling vessel. A timely implementation to suspend drilling operations, shut-in the well, and disconnect from the stationkeeping system may be desired. As mentioned, a major time component to shut down the system may be retrieval of the drilling riser, particularly in deeper water depths.

To reduce the time to retrieve the riser, the shut-down operation may generally either (1) pull the same length of riser at a faster rate or (2) pull a smaller length of riser. The former option generally gives only incremental reductions in time spent pulling riser. In contrast, the latter option of substantially reducing the length of riser pulled may give a step change in time reduction. Thus, as indicated, drilling risers may be disconnected at mid-height with a remaining freestanding lower portion or at the LMRP with the drilling vessel towing the neutrally or negatively buoyant drilling riser under control of the tensioners.

Embodiments of the present techniques are directed to a timely shutdown of the subsea drilling operation including disconnecting the drilling riser and well from the drilling vessel and stationkeeping system. Embodiments include drilling risers that may be disconnected at an intermediate height along the drilling riser, leaving a freestanding lower portion of the drilling riser in place. To reduce the time to retrieve the riser, a relatively shorter length of the riser is removed. The detached portion may be removed at typical or faster rates.

The reduction in time via a shorter length of pulled riser can beneficially give more drilling uptime. Further, the reduction in time via shorter length of pulled riser portion may advantageously lower the number of disconnections by decreasing the size of the exclusion zone surrounding the drilling vessel. Therefore, the probability of an adverse environmental condition entering the exclusion zone may be reduced. The techniques may be beneficial in a variety of environments such as in Arctic situations with a relatively greater number of ice features, or in other offshore environments.

In sum, distributed passive buoyancy of the lower section of the drilling riser is designed to be positively buoyant such that the lower section can remain freestanding when disconnected from the upper section of the drilling riser. The complete drilling riser, however, when in operation may be negatively buoyant, slightly negatively buoyant, or substantially neutrally buoyant, so that the drilling riser may be controlled, for instance, by tensioners of the drilling vessel. The negatively or neutrally buoyant drilling riser with a positively buoyant lower section can reduce the time to disconnect the drilling vessel from the well in anticipation of potential impending adverse environmental conditions such as approaching storms or ice.

FIG. 1 is a diagram of an exemplary subsea drilling system 100 having a subsea drilling riser 102 with distributed buoyancy. The drilling riser 102 is disposed between a drilling vessel 104 and a subsea wellhead 106. The drilling vessel 104 may have one or more moon pools 105. In the illustrated embodiment, the drilling riser 102 is in place for drilling operations. The drilling riser 102 has a lower section 108 coupled via a connector 110 to an upper section 112 of the drilling riser 102. The connector 110 may be a mid-riser connector or a component of a mid-riser connector package. In implementation, when the drilling vessel 104 is to abandon the location, the drilling riser 102 disconnection can be made at the connector 110, and the upper section 112 of the riser 102 retrieved, leaving the lower section 108 (see FIG. 2). In certain embodiments, the upper section 112 is relatively short in comparison to the lower section 108. Such may be beneficial to the timely decoupling of the drilling vessel 104 and upper section 112 from the lower section 108 and the wellhead 106

The lower section 108 has buoyant joints or buoyant portion 114 (a first length of the lower section) and non-buoyant joints or non-buoyant portion 116 (a second length of the lower section). The buoyant joints or portion 114 has a buoyant material 118, as discussed below, and which provides for distributed passive buoyancy. The non-buoyant joints or portion 116, which may also be labeled as slick joints, does not generally have a buoyant material disposed thereon and may be, for example, typical drilling riser conduits. However, the non-buoyant joints or portion 116 may be configured with buoyant material or other features if desired.

The lower section 108 of the drilling riser 102 may be coupled, for example, to a blowout preventer (BOP) 120 through a lower marine riser package (LMRP) (not shown). In the illustrated embodiment, the BOP 120 is disposed atop the wellhead 106 which may be several meters above the mudline 122, such as per typical practices. Of course, other interface configurations of the drilling riser 102 with the wellhead 106 may be accommodated with embodiments of the present techniques. The upper section 112 of the drilling riser 102 may be coupled to the drilling vessel 104 at or through the drill floor 124 of the drilling vessel 104. In the illustrated embodiment, the drilling riser 102 is coupled to the drilling vessel 104 via riser tensioners 126 above the mean water line 128. Other interface configurations of the drilling riser 102 with the drilling vessel 104 may be accommodated by embodiments of the present techniques. Moreover, the drilling riser 102 may be insulated to withstand seafloor temperatures, and can be rigid and/or flexible.

In operation, the drilling riser 102 facilitates drilling of the well underlying the wellhead 106 at the seafloor. Conduit(s) of the drilling riser 102 transfer materials between the seafloor and the drilling vessel 104 (and other sea surface facilities) at the water surface. The transport via the drilling riser 102 between the BOP 120 and the drilling vessel 104 may generally be a vertical transportation in some examples. Moreover, the materials transported by the drilling riser 102 may be drilling materials (e.g., mud, drilling fluids, etc.), as well as any production fluid (e.g., hydrocarbon, oil, gas, etc.) recovered or produced during the drilling. The transport of material by the drilling riser 102 may be from the wellhead 106 to the drilling vessel 104 and stationkeeping system, and from the drilling vessel 104 to the wellhead 106.

The use of distributed passive buoyancy as opposed to conventional buoyancy systems can offer several advantages. For example, in fabrication, the buoyancy cans of conventional systems are generally relatively large and complicated structures, compared to buoyant modules employed in drilling risers. With respect to installation, distributed buoyancy joints are typically easier to deploy, through the moonpool and splash zone, than large buoyancy cans and are commonly less susceptible to damage. Furthermore, spare modules may generally more easily replace damaged units during installation, as opposed to a unique buoyancy can, that may need to be repaired if damaged during installation.

In operation, the distributed passive buoyancy can generally be more reliable than concentrated buoyancy using cans or inflatable bags. Indeed, the cans or inflatable bags may be more susceptible to unintentional flooding, that would lead to loss of the lower section of the riser. The cans or bags typically are designed with compartmentalization and, in some cases, active systems to control buoyancy. Conversely, passive buoyancy is generally not subjected to equipment failures or malfunction, or human error. Moreover, the distributed or passive buoyancy is typically more redundant than concentrated buoyancy elements. Lastly, passive buoyant systems can be advantageous with rapid disconnection where the riser is disconnected at the lower marine riser package (LMRP) and the drilling vessel carries the entire riser from the location. During this relocation, the use of distributed buoyancy can give more favorable distribution of stresses in the riser than with concentrated systems, as there generally may be no substantial discontinuity in the curvature with distributed systems.

Figure 2:
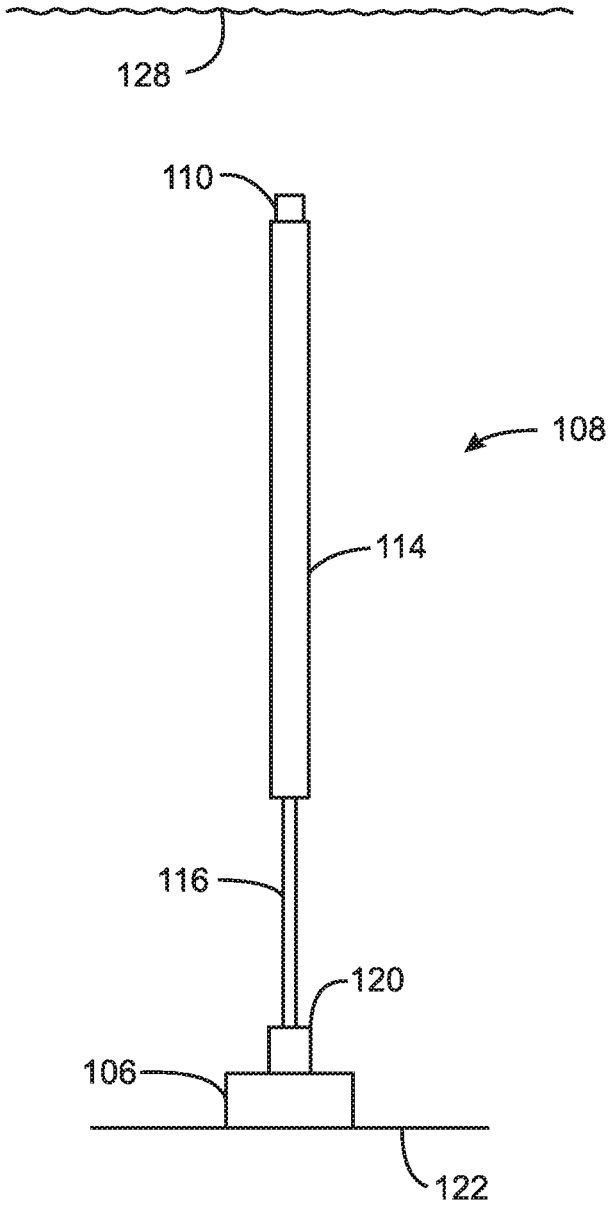
FIG. 2 is a diagram of the subsea drilling system of FIG. 1 but with an upper section of the drilling riser removed to relocate the drilling vessel.

FIG. 2 is a diagram of a subsea drilling system 100A which is the subsea drilling system 100 of FIG. 1 but with the upper section 112 (of the drilling riser 102) removed after shutdown of the subsea drilling system 100. With respect to the Figures, similar features utilize similar reference numerals. As indicated above, the upper section 112 may be removed and the drilling operation shutdown in anticipation of adverse environmental conditions. In particular, the upper section 112 may be removed and the stationkeeping system disconnected and moved, for example, in response to an approaching environmental condition (e.g., storm and/or ice) that might place excessive load on the drilling vessel 104 and associated stationkeeping system. Moreover, it should be noted that while the connector 110 is depicted for clarity, most or all of the connector 110 assembly or package may be removed when the upper section 112 is disconnected and removed from the lower section 108.

When the lower section 108 is freestanding, underwater current forces may act upon the lower section 108 causing lateral movement. Therefore, the lower section 108 may include a stabilizing device, such as one or more tethering lines, one or more mooring lines, a trussed frame, dynamic positioning thrusters and the like, to limit lateral offset of the lower section 108 when it is disconnected from the upper section 112 and is freestanding. Limiting lateral offset and the angle of the lower section 108 can also facilitate reconnection of the upper section 112 to the lower section 108.

The respective lengths of the various linear portions and sections of the drilling riser 102 and buoyant material 118 may be specified to give desired buoyancy of the drilling riser 102 and of the lower section 108. Referring again to FIG. 1, some of these respective lengths are indicated by dimensional lines 130-136. In the design and manufacture of the drilling riser, the various lengths and also ratios of lengths may be determined and specified. For example, the ratio of the length 130 of the lower section 108 to the length 132 of the upper section 112 and/or to the total length of the drilling riser 102 may be specified. Additionally, the ratio of the length 134 of the buoyant portion 114 of the lower section 108 proximate the upper section to the length 136 of the non-buoyant 116 portion of the lower section 108 proximate the subsea wellhead may be designed and specified, for example the ratio of the length of 134 to the length of 136 may be in exemplary ranges of at least 0.5, at least 0.75, at least 1, at least 1.25, at least 1.5 at least 2, at least 5 or at least 10. Moreover, the dimensions and properties of the buoyant material 118 may be specified.

These variables may be calculated and specified such that: (1) the lower section 108 is positively buoyant so that the lower section 108 remains freestanding when disconnected from the upper section 112 of the drilling riser 102; and (2) the entire drilling riser 102 is neutrally buoyant or negatively buoyant so that the drilling riser 102 may be controlled, for instance, by the tensioners 126 of the drilling vessel 104. The neutrally or negatively buoyant drilling riser 102 with a positively buoyant lower section 108 can reduce the time to disconnect the drilling vessel 104 from the wellhead 106 in anticipation of potential impending adverse environmental conditions such as approaching storms or ice.

In the illustrated embodiment of FIG. 1, the length of the drilling riser 102 is the length 132 of the upper section 112 plus the length 130 of the lower section 108. Of course, any additional length contribution by the connector 110 may be accounted. The length 132 of the upper section 112 may be specified as a relatively short length but long enough to avoid, for instance, significant impact of sea waves or ice features on the lower section 108 as the lower section remains freestanding in place. Exemplary ranges of the length 132 of the upper section 112 include 25 meters to 150 meters or greater, or 50 meters to 100 meters.

The length 130 of the lower section 108 may be the remaining length of the drilling riser 102 to the BOP 120. In other words, the length 130 of the lower section 108 completes the water depth from the upper section of the riser 102 and the drilling vessel 104. Thus, the length 130 of the lower section 108 may be a function of the depth of wellhead 106 below sea level 128. Of course, the water depth and thus the length of the lower section 108 may vary depending on location in the sea of the wellhead 106, and on the length 132 chosen for the upper section 112, and so on.

Moreover, the length 134 of the buoyant portion 114 (e.g., having the buoyant material 118) of the lower section 108 may be calculated and specified to give the desired positive buoyancy of the lower section 108. This length 134 may be related to the overall length 130 of the lower section 108, as well as a function of the diameter and other properties of the buoyant material 118, and so on. Further, as mentioned, the ratio of the length 134 of the buoyant portion 114 (e.g., having the buoyant material 118) to the length 136 of the non-buoyant portion 116 (e.g., slick joints) may be specified to give a desired positive buoyancy of the lower section 108 and a neutral or negative buoyancy of the overall drilling riser 102.

Also, the ratio of the length 134 of the buoyant portion 114 or buoyant material 118 to the diameter of the buoyant material 118 may be specified. This length to diameter (L/D) ratio of the buoyant material 118 may be calculated or otherwise determined to give the desired buoyancies of the lower section 108 and drilling riser 102. In embodiments, this L/D ratio may be relatively large as to provide for distributed buoyancy instead of concentrated buoyancy, for example the L/D ratio may be in exemplary ranges of at least 5, at least 10, at least 25, at least 50, at least 100, or at least 1000. The distributed buoyancy of some embodiments may be beneficial in not giving multiple relatively large discontinuities of the drilling riser 102 exterior surface as in concentrated buoyancy systems, for example the buoyant material 118 may cover at least 50%, at least 75%, at least 80%, at least 90% or substantially 100% of the exterior of the buoyant portion 114. Concentrated buoyancy systems employing buoyance tanks, for example, can unfortunately give significant drag on the drilling riser.

Figure 3:
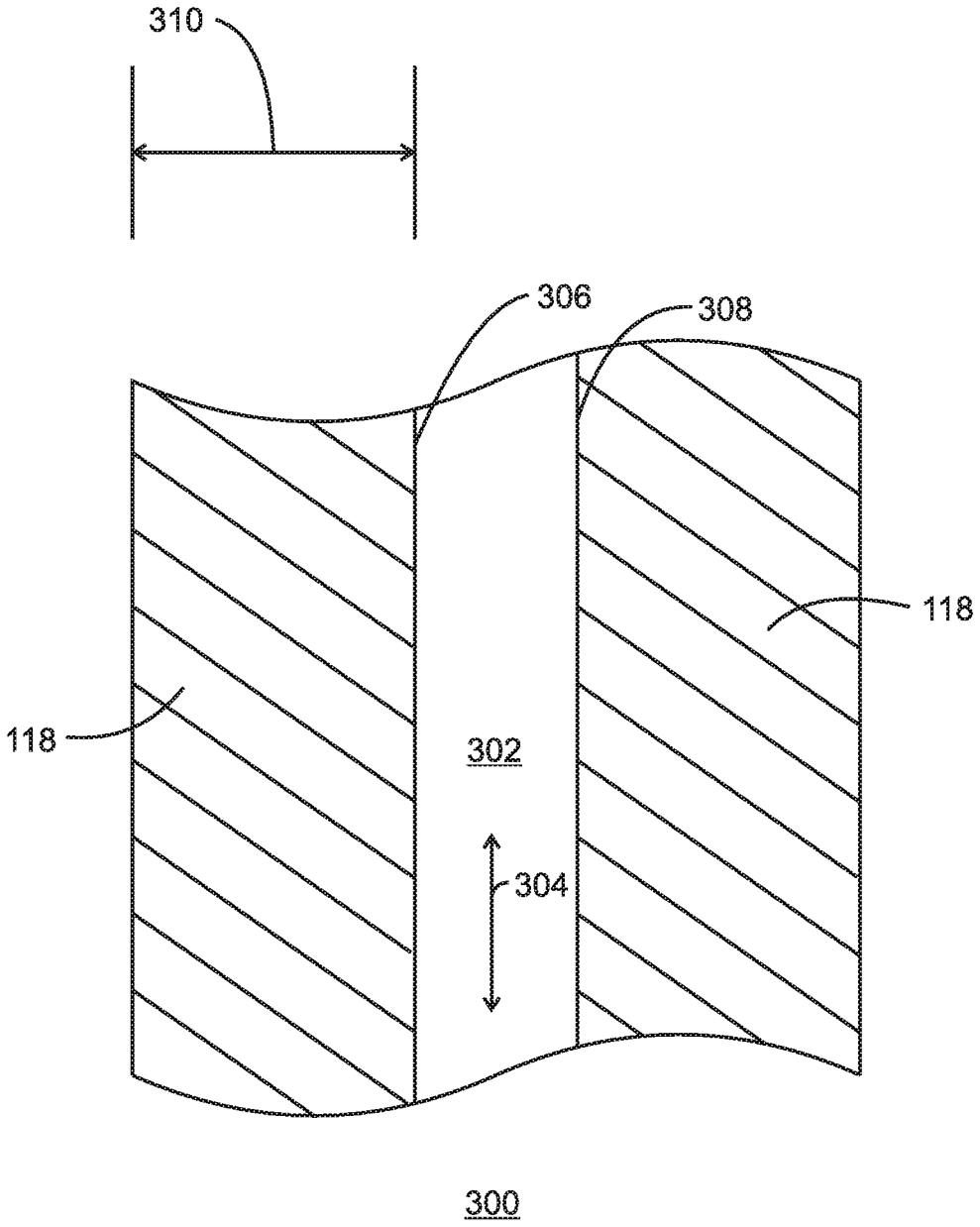
FIG. 3 is a side cross-section of a representative part of the buoyant portion of the lower section of FIG. 1.

FIG. 3 is a vertical or side cross-section of a representative portion 300 of the exemplary buoyant portion 114 of the lower section 108. The lower section includes a primary conduit 302 having a flow path 304 defined by an inner surface 306. The lower section includes the lower part of the primary conduit 302 of the drilling riser. The upper section 112 (see FIG. 1) includes the upper part of the primary conduit 302 of the drilling riser. In operation, the primary conduit 302 of the drilling riser may convey drilling materials between the drilling vessel 104 and the wellhead 106 (see FIG. 1). For the sake of clarity, auxiliary lines of the drilling riser are not depicted. Auxiliary lines, if present, may be disposed running through and/or external to the buoyant material 118.

The buoyant material 118 is disposed on the outer surface 308 of the primary conduit 302 of the buoyant portion 114 of the lower section 108 (see FIGS. 1 and 2). The buoyant material 118 has a thickness 310. The thickness 310, length 134 (FIG. 1), and other properties (e.g., density, etc.) of the buoyant material 118 may be specified to give the desired positive buoyancy of the lower section 108 and the desired neutral or negative buoyancy of the overall drilling riser 102. In embodiments, the thickness 310 or diameter of the buoyant material 118 may be substantially greater than non-concentrated buoyancy modules of a drilling riser in conventional systems.

The present techniques apply distributed buoyancy in sufficient diameter to provide for a positively buoyant freestanding lower section 108 of the drilling riser 102. For example, the thickness 310 may be in exemplary ranges of 0.25 meter to 5 meters, 0.25 meter to 2.5 meters, 0.25 meter to 1 meter, or 0.5 meter to 2 meters. The value of the thickness 310 determined and specified may generally depend on the particular drilling subsea application, the material selection of the buoyant material 118, and so forth. Moreover, in some examples, both the thickness 310 and the material selection of the buoyant material 118 may be different than in conventional systems to give greater buoyancy. Indeed, in certain embodiments, the buoyant material 118 may be different and have greater buoyancy than the syntactic foam or glass spheres of buoyant material in conventional drilling systems. Exemplary units of the buoyancy may be in weight per unit length such as pound force per foot (lbf/ft) or kilo-Newton per meter (kN/m).

In the illustrated embodiment of FIG. 3 (and FIG. 4), the buoyant material 118 forms an annulus around the outer diameter or outer surface 308 of the primary conduit 302. As indicated by the depiction in FIG. 3 (and FIG. 4), the nominal outer diameter of the buoyant material 118 is twice the thickness 310 plus the diameter of the primary conduit 302.

Further, the buoyant material 118 may be disposed substantially continuously along joints of the buoyant portion 114 of the lower section 108 to give distributed buoyancy. Also, the buoyant material 118 provides for passive buoyancy in that an active or operationally controllable implementation of the buoyant material 118 is not required. In other words, the buoyant material 118 is passively in place as installed to provide buoyancy without activation. In all, the buoyant material 118 provides for a distributed passive buoyancy of the lower section 108. As discussed, the lower section 108 of the drilling riser 102 can remain freestanding after the upper section 112 of the drilling riser 102 is removed.

Figure 4:
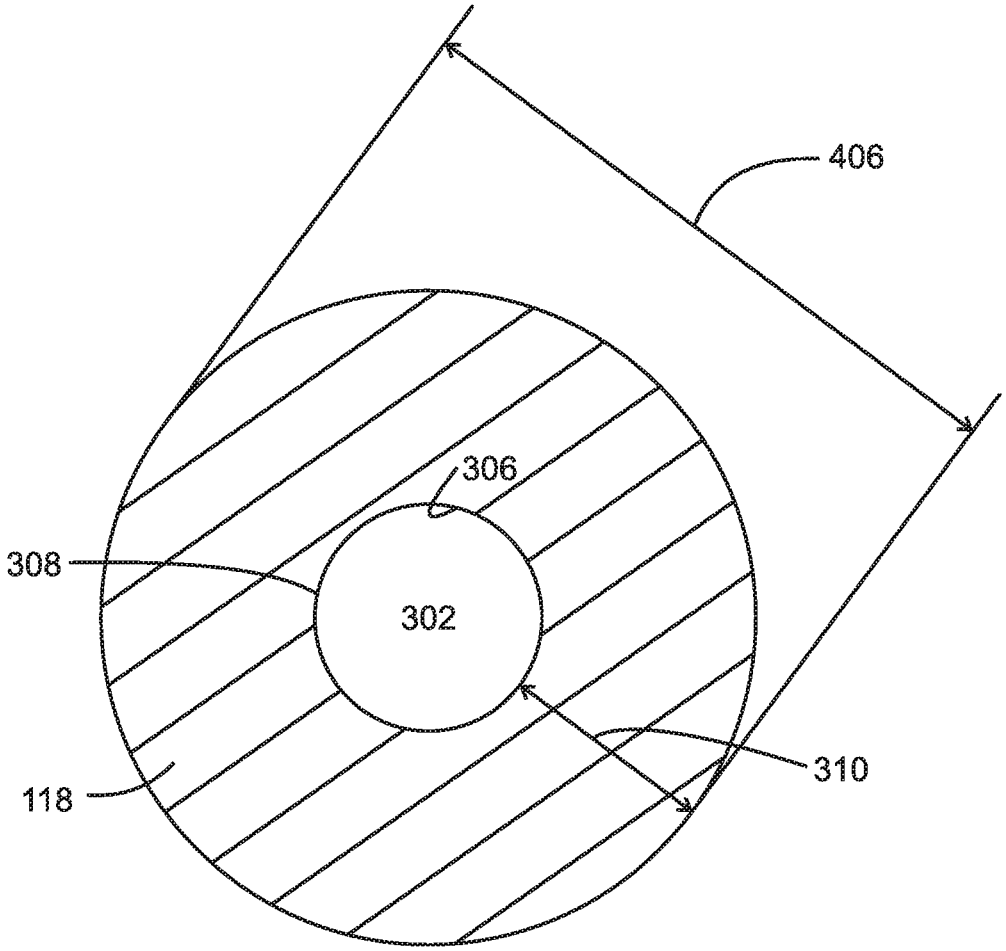
FIG. 4 is a top cross-section of the buoyant portion of the lower section of FIG. 1.

FIG. 4 is a horizontal or top cross-section of the buoyant portion 114 of the lower section 108. The primary conduit 302 of the drilling riser has an inner surface 306 and an outer surface 308. The buoyant material 118 is included on the buoyant portion 114 and is disposed on the outer surface 308 of the primary conduit 302. The buoyant material 118 has a thickness 310 and an overall diameter 406. The diameter 406 of the buoyant material 118 will incorporate the diameter of the primary conduit 302. For example, the diameter 406 of the buoyant material may be in the exemplary range of 0.75 meter to 10 meters, 1 meter to 5 meters, or 1.25 meter to 4 meters. The thickness 310 or diameter 406, the length 134 (see FIG. 1), and other properties of the buoyant material 118 may be specified to give: (1) desired buoyancy, e.g., positively buoyant, of the lower section 108 that remains freestanding in place upon shutdown of the drilling operation; and (2) desired buoyancy, e.g., neutrally or negatively buoyant, of the drilling riser 102 when in operation. For the sake of clarity, auxiliary lines of the drilling riser 102 are not depicted. Auxiliary lines, if present, may be disposed running through and/or external to the buoyant material 118.

Figure 5:
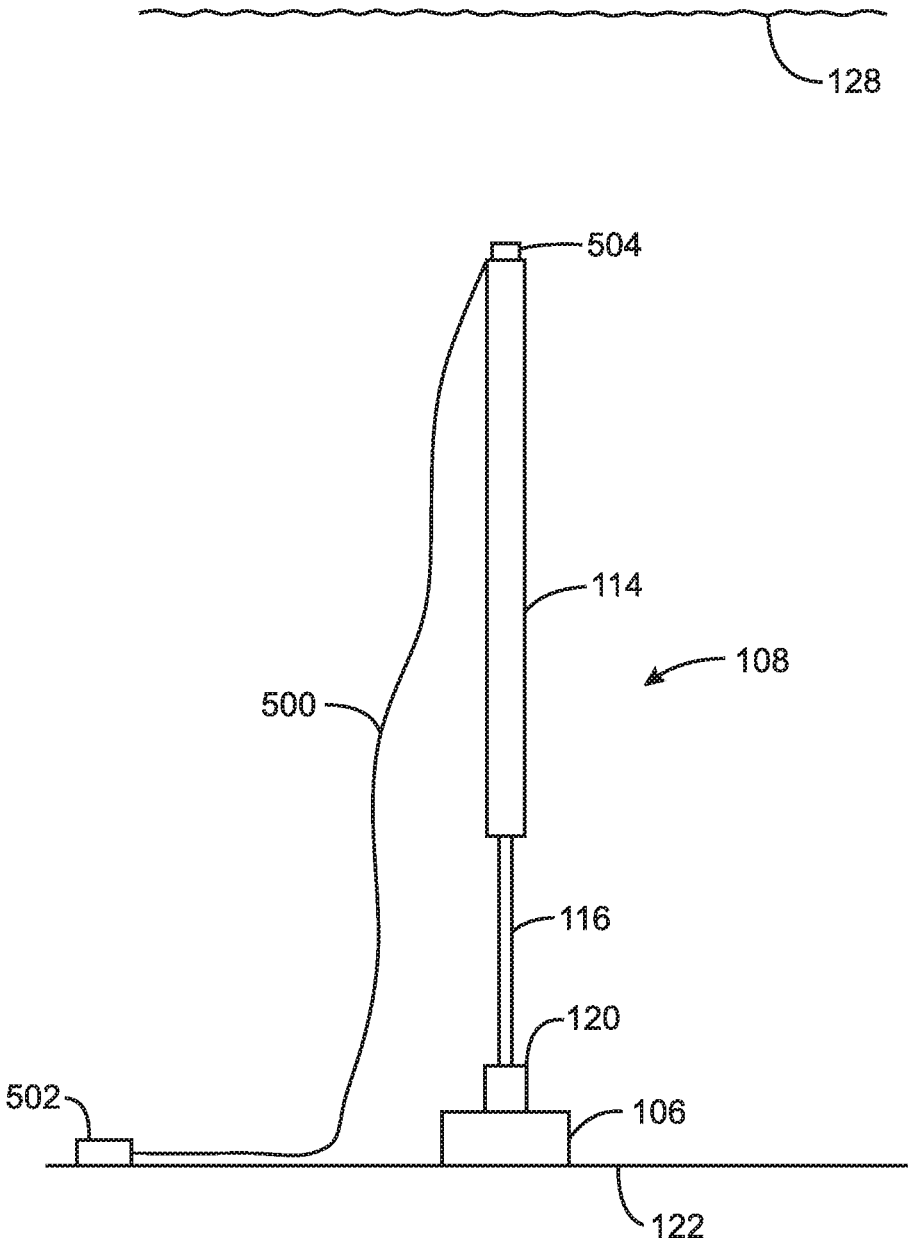
FIG. 5 is a diagram of the lower section freestanding as depicted in FIG. 2 but with an optional tethering line.

FIG. 5 is a diagram of a subsea drilling system 100B which is the subsea drilling system 100A of FIG. 2 but with at least one tether or line 500, such as chain(s), coupling the freestanding lower section 108 of the drilling riser 102 to anchor(s) 502. The line 500 may couple to the lower section 108 via an assembly 504. For example, the coupling assembly 504 may be generally disposed near or at the position of the connector 110 (see FIGS. 1 and 2). The anchored line 500 may reduce movement (e.g., upward movement) of the lower section 108 in the event of a failure (e.g., structural failure) of the lower section 108 when freestanding and disconnected from the upper section 112 of the drilling riser 102.

The tether or line 500 may be in contrast to restraining cables used during drilling operations. In other words, as opposed to restraining cables, the line 500 generally need not be present during normal operation of the drilling riser 102 but instead deployed only in preparation for disconnection of the lower section 108 from the upper section 112.

After installed, the line 500 may be hung slack without affecting the drilling riser 102, except in cases of failure of the disconnected lower section 108. The line 500 may restrain the positively-buoyant freestanding lower section 108 from moving upward. The line 500 may be configured as not to restrain the overall drilling riser 102 and not to restrain the lower section 108 when freestanding without failure. The line 500 may restrain the freestanding lower section 108 when failed and attempting to move upward. In other embodiments (not shown), two or more tether lines may be used as a stabilizing device to limit lateral offset of the lower section when freestanding and disconnected from the upper section.

Figure 8:
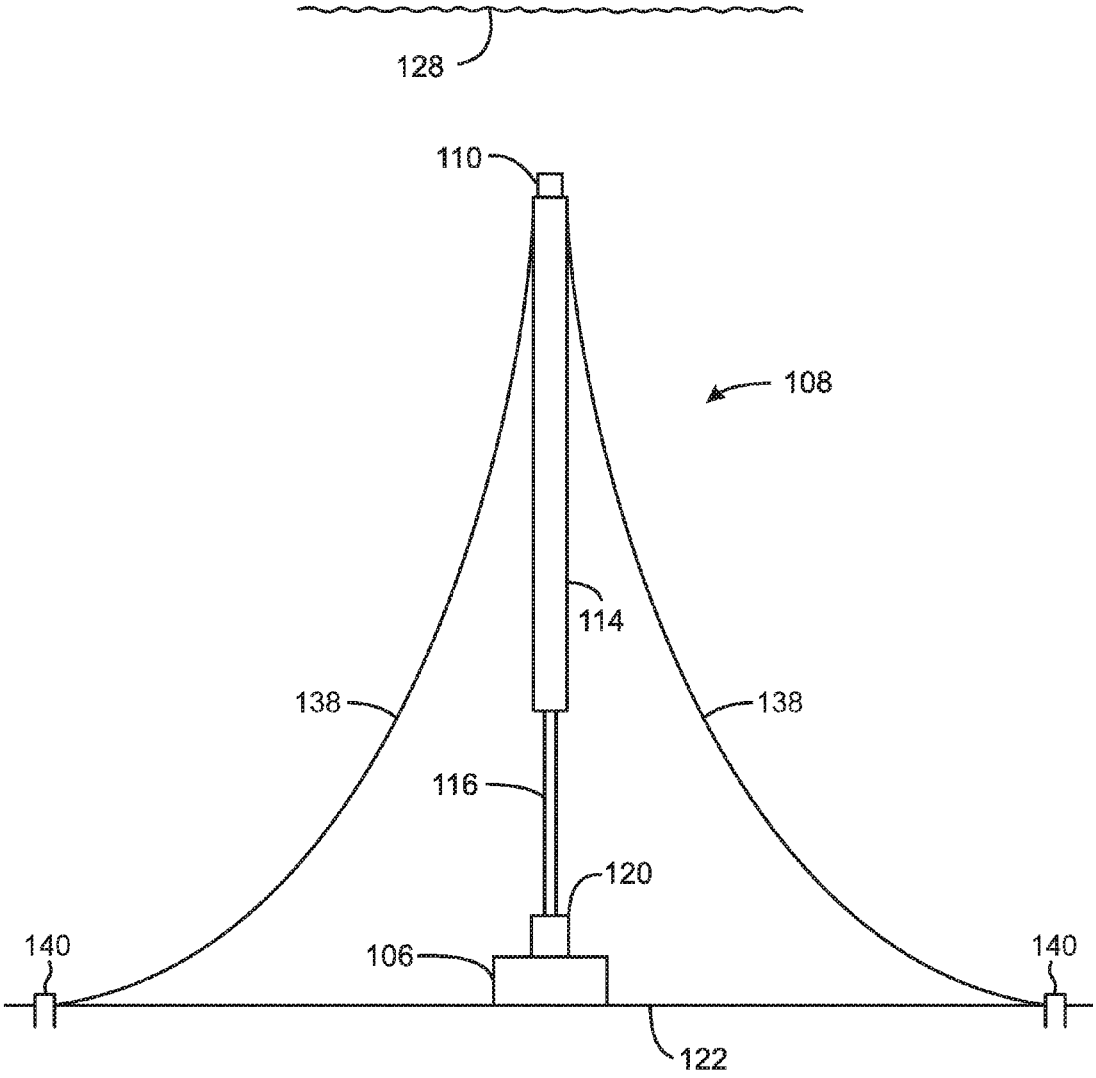
FIG. 8 is a diagram of the lower section freestanding as depicted in FIG. 2 but with an optional stabilizing device.

FIG. 8 is a diagram of a subsea drilling system 100C which is the subsea drilling system 100A of FIG. 2 but with a stabilizing device including a plurality of mooring lines connected proximate the upper end of the lower section 108 to limit lateral offset. The lower end of the mooring lines are attached to the seafloor using a pile 140. Although piles 140 are depicted in FIG. 8 to secure the lower end of the mooring lines to the seafloor, anchors or deadweights may be used. Any number of mooring lines may be used, for example two mooring lines circumferentially spaced apart by one hundred and eighty degrees, four mooring lines circumferentially spaced apart by ninety degrees, etc.

Figure 9:
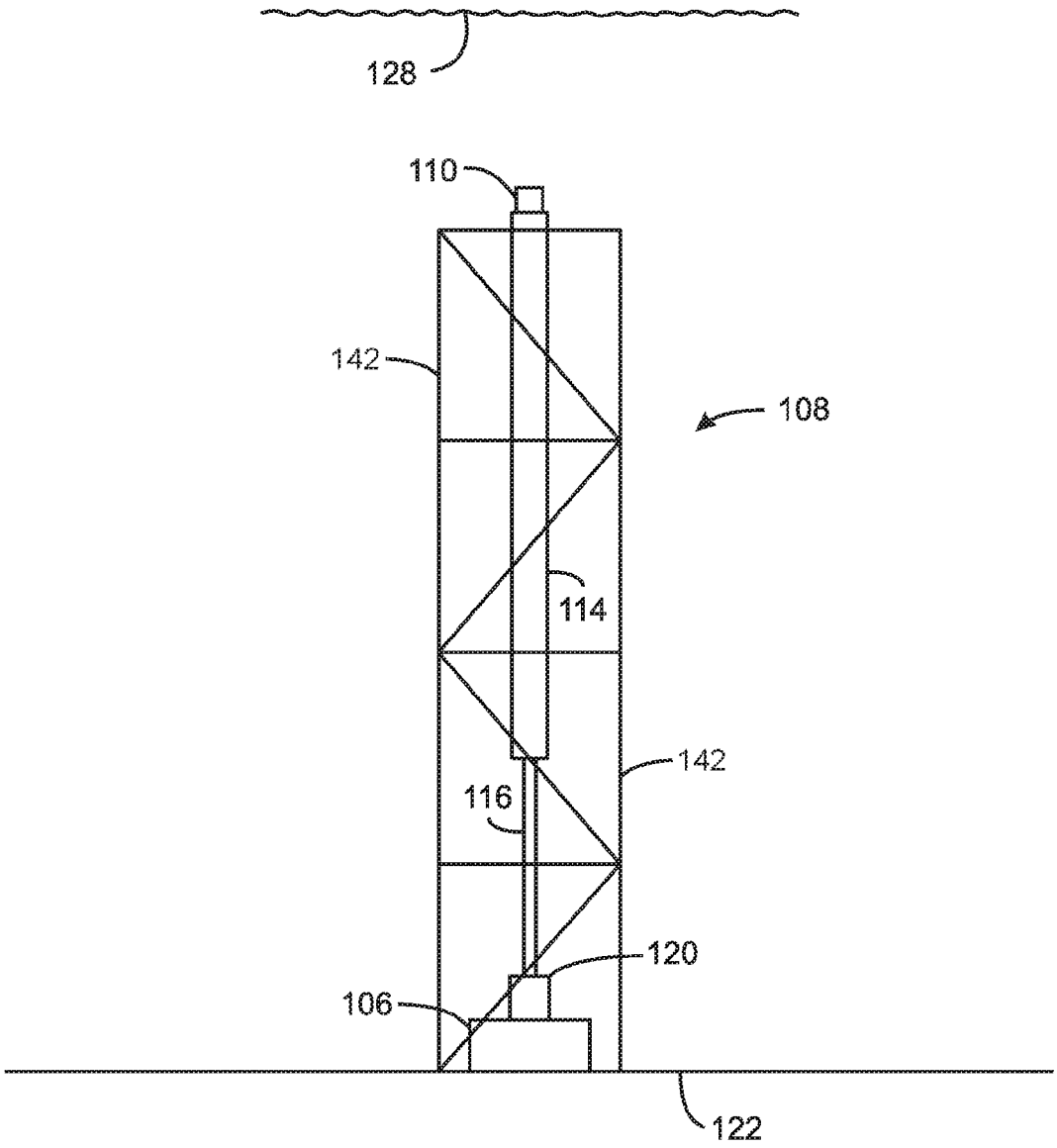
FIG. 9 is a diagram of the lower section freestanding as depicted in FIG. 2 but with an optional stabilizing device.

FIG. 9 is a diagram of a subsea drilling system 100D which is the subsea drilling system 100A of FIG. 2 but with a stabilizing device including a trussed frame 142 disposed around the lower section 108 extending from the seafloor to proximate the upper end of the lower section 108 and configured to limit lateral offset. Although a trussed frame is depicted in FIG. 9, any suitable frame structure may be used to limit the lateral offset of the lower section 108.

Figure 6:
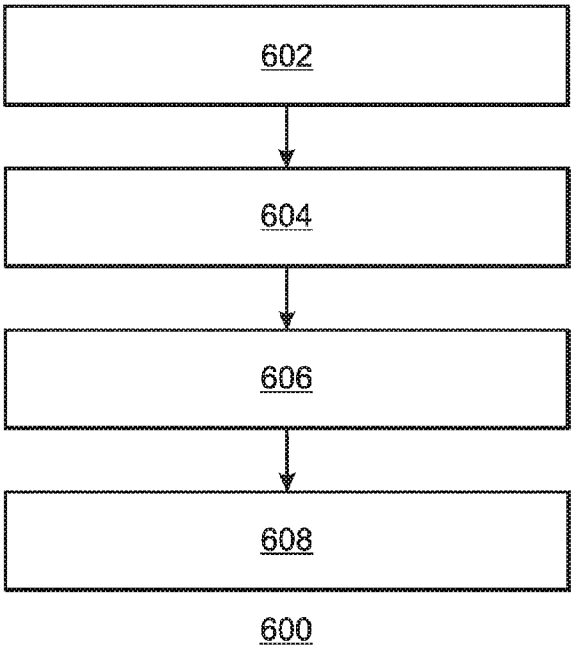

FIG. 6 is a block diagram of an exemplary method 600 of manufacturing a drilling riser with distributed passive buoyancy for a subsea drilling system. At block 602, the method includes fabricating a lower section of the drilling riser having a lower portion of a conduit for conveying drilling material. The lower section may be a plurality of linear joints. The lower section is fabricated to couple via a connector to an upper section of the drilling riser having an upper portion of the conduit for conveying the drilling material.

At block 604, the method 600 determines the amount of buoyant material to dispose on the lower section such that the lower section is positively buoyant when disconnected from the upper section and the drilling riser is negatively buoyant in operation. Such a determination may include determining a length of the buoyant material and a thickness (or diameter) of the buoyant material. If so, the thickness (or diameter) and length of the buoyant material may be specified to give negative buoyancy of the drilling riser and positive buoyancy of the lower section. The determination may include determining a length to diameter ratio of the buoyant material. Indeed, a length to diameter ratio of the buoyant material may be specified that gives negative buoyancy of the drilling riser and positive buoyancy of the lower section. Moreover, the composition or type of the buoyant material may be determined and selected to give desired buoyancies. The buoyancy of the buoyant material in force per length may be specified. In sum, the type and amount of buoyant material determined and to be disposed on the lower section provides for the drilling riser to be negatively buoyant in operation, and the lower section to be positively buoyant when disconnected from the upper section of the drilling riser and coupled to the wellhead.

At block 606, the method 600 includes disposing the buoyant material on the lower section. The buoyancy material may be attached via straps, for example, to the drilling riser and to couple buoyancy material modules to each other. Of course, other coupling features such as adhesive, clamps, bolting, and so forth, may be employed to couple buoyancy material modules to the drilling riser and to each other.

In certain examples, the buoyant material may be disposed on a specified number of the linear joints of the lower section which may be substantially contiguous or non-contiguous. The fabrication of the lower section and the installation of the buoyant material may be such that the lower section has a first length of the conduit with the buoyant material, and a second length of the conduit without the buoyant material. In other words, disposing the buoyant material on the lower section may involve disposing the buoyant material on the first linear length of the lower section but not on a second linear length of the lower section. In certain examples, determining the amount of buoyant material includes determining a ratio of this first linear length to the second linear length. If so, a ratio of the first length to the second length may be specified to give a desired magnitude of positive buoyancy of the lower section.

At block 608, the method 600 may include fabricating a tether line(s) or stabilizing device and associated assembly that are configured to couple to the lower section in advance of decoupling the lower section from the upper section. The tether lines may be fabricated to attach to an anchor or deadweight. Thus, one end of the tether line may couple to an anchor or deadweight and the other end of the tether line may couple via an assembly to the lower section of the drilling riser (see e.g., FIG. 5). The tether system may be fabricated such that the anchored tether line prevents or reduces upward movement of the lower section of the drilling riser, such as in the event of a structural failure of the lower section when freestanding and disconnected from the upper section of the drilling riser. A stabilizing device may be fabricated such that the lateral movement of the lower section of the drilling riser is limited when connected to the wellhead and freestanding.

Figure 7:
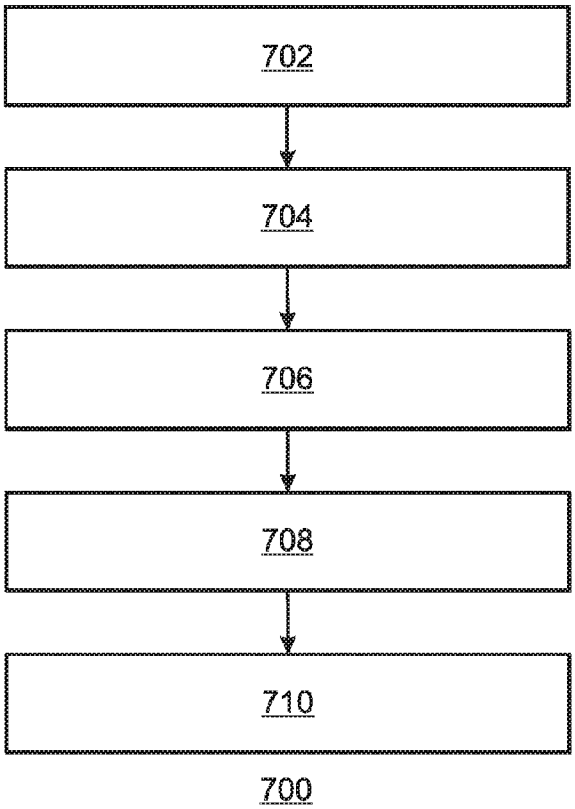
FIG. 7 is a block diagram of an exemplary method of operating a subsea drilling system having a drilling riser with passive buoyancy.

FIG. 7 is a block diagram of an exemplary method 700 of operating a subsea drilling system having a drilling riser with a lower section configured with distributed passive buoyancy. At block 702, the method 700 includes conveying drilling material through a conduit of the lower section and of an upper section of the drilling riser, and with the lower section coupled to a subsea wellhead and the upper section coupled to a drilling vessel. The drilling riser with both the upper and lower sections is neutrally or negatively buoyant. In some examples, control of the stability of the drilling riser may be facilitated via tensioners of the drilling vessel.

At block 704, the method 700 includes suspending drilling operations (including stopping conveying of drilling materials) and shutting in the well using an appropriate number of barriers to flow, then decoupling the upper section from the lower section. The decoupling may be accomplished, for example, by disconnecting the upper section from the lower section via a connector that couples the upper section to the lower section. In some examples, the connector may be a mid-riser connector or a component of a mid-riser connector package. As discussed, the drilling vessel and upper section may be decoupled from the lower section and wellhead in advance of impending adverse environmental conditions. At block 706, the method 700 includes relocating the drilling vessel and the upper section. This may involve relocating the drilling vessel and the upper section away from the subsea wellhead to outside of a path of any adverse environmental conditions that would impose a load on the drilling vessel in excess of stationkeeping capacity.

At block 708, the method 700 includes leaving the lower section coupled to the subsea wellhead, wherein the lower section has a buoyant material that is distributed and passive, and wherein the lower section is positively buoyant. Thus, after decoupling of the upper section, the lower section may remain coupled to the shut-down wellhead and freestanding, and supported by the buoyant material. The lower section may have a submerged weight of −120,000 kilogram force of less. At block 710, the method 700 includes installing a tether line or stabilizing device on the lower section. With respect to the tether line, one end of the tether line may be coupled to an anchor or deadweight, and the other end of the tether line coupled via an assembly to the lower section. The tether line may be so installed before or after the decoupling of the upper section of the riser from the lower section of the riser. However, the tether line and associated assembly may be configured to restrain the freestanding lower section of the drilling riser from upward movement but not to restrain the overall drilling riser. Further, the tether line and associated assembly may be configured not to significantly restrain the lower section of the riser when the freestanding lower section is not failed and is as desired in the freestanding state. With respect to the stabilizing device, one end may be positioned on the seafloor and the other end positioned proximate the upper end of the lower section such that the lateral offset of the lower section of the drilling riser may be limited when disconnected from the upper section and freestanding.

EXAMPLE

In a prophetic example, a drilling riser 102 is 1,000 meters in length. The upper section 112 of the drilling riser 102 is 100 meters in length and does not have (is free of) buoyant material 118. The upper section 112 has a submerged weight of 50,000 kilogram force (kgf). The upper section 112 may be disconnected via a mid-riser connector 110 from the lower section 108 of the drilling riser 102. Therefore, the upper section 112 may be carried away with the drilling vessel 104.

The mid-riser connector 110 has a submerged weight of 30,000 kgf Upon disconnection of the upper section 112 from the lower section 108, part of the mid-riser connector 110 may be removed or carried away with the upper section 112 and the drilling vessel 104. The remaining portion of the mid-riser connector 110 may remain with the freestanding lower section 108.

The lower section 108 of the drilling riser 102 is 900 meters in length, and is coupled via an LMRP to a BOP 120 of the wellhead 106. The lower section 108 is configured to remain freestanding after disconnection from the upper section 112. The lower section 108 has a buoyant portion 114 that is 450 meters in length, and a non-buoyant portion 116 that is 450 meters in length. The buoyant portion 114 has a submerged weight of −360,000 kgf. The non-buoyant portion 116 has a submerged weight of 225,000 kgf. The LMRP has a submerged weight of 100,000 kgf. The aforementioned lengths and submerged weights are given in Table 1 below. Corresponding reference numerals of FIG. 1 are also listed.

TABLE 1

Example Data

| Component | FIG. 1 | Submerged Weight per Unit Length (kgf/m) | Length (m) | Total Submerged Weight (kgf) |
|---|---|---|---|---|
| bare joints | 112 | 500 | 100 | 50,000 |
| mid-riser connector | 110 | | | 30,000 |
| buoyant joints | 114 | −800 | 450 | −360,000 |
| bare joints | 116 | 500 | 450 | 225,000 |
| LMRP | 120 | | | 100,000 |

The drilling riser 102 including the LMRP has a submerged weight of 45,000 kgf (negatively buoyant). The freestanding lower section 108 plus about half of the mid-riser connector 110 that remains has a submerged weight of −120,000 kgf (positively buoyant). In particular, the buoyant portion 114 of the lower section 108 is −360,000 kgf, the non-buoyant portion 116 is 225,000 kgf, and the part of the mid-riser connector 110 that remains coupled to the lower section 108 is about 15,000 kgf. Again, these three contributions sum to give a submerged weight of −120,000 kgf for the lower section 108 of the drilling riser left freestanding.

Thus, the lower section 108 of the drilling riser 102 that remains freestanding (after disconnection from the upper section 112 and the drilling vessel 104) is positively buoyant, whereas the entire drilling riser 102 in place is negatively buoyant. To implement such a configuration in this example with the drilling riser 102 having a main conduit of about 0.5 m nominal diameter, a buoyant material 118 of about 2 meters in diameter and having a weight density of 518 kgf/cubic meter (kgf/m3) is disposed along the 450 meters on the buoyant portion 114 of the lower section 108.

While the present techniques may be susceptible to various modifications and alternative forms, the exemplary embodiments discussed above have been shown only by way of example. However, it should again be understood that the techniques are not intended to be limited to the particular embodiments disclosed herein. Indeed, the present techniques include all alternatives, modifications, and equivalents falling within the true spirit and scope of the appended claims.

What is claimed is:

1. A drilling riser having a conduit to convey drilling materials between a drilling vessel and a subsea wellhead, the drilling riser comprising:

an upper section; and a lower section coupled via a connector to the upper section and comprising a buoyant material for distributed passive buoyancy over a substantial length of the lower section, wherein the buoyant material of the lower section provides for the drilling riser to be neutrally buoyant or negatively buoyant, and wherein the buoyant material of the lower section provides positive buoyancy of the lower section when decoupled from the upper section and coupled to the subsea wellhead, and wherein the buoyant material provides substantially constant buoyancy over time.

2. The drilling riser of claim 1, wherein the buoyant material has a diameter and a length along the lower section, and the ratio of the length to diameter is at least 5.

3. The drilling riser of claim 1, wherein the buoyant material has a diameter and a length along the lower section, and the ratio of the length to diameter is at least 100.

4. The drilling riser of claim 1, wherein the buoyant material has a thickness in the range of from about 0.25 meter to about 5 meters.

5. The drilling riser of claim 1, wherein the buoyant material has a thickness in the range of from about 0.25 meter to about 2.5 meters.

6. The drilling riser of claim 1, wherein the lower section comprises a first length of the conduit proximate the upper section including the buoyant material, and a second length of the conduit proximate the subsea wellhead without the buoyant material, wherein a ratio of the first length to the second length is at least 0.5.

7. The drilling riser of claim 6, wherein the ratio of the first length to the second length is at least 1.

8. The drilling riser of claim 6, wherein the buoyant material covers at least 80 percent of the first length of the conduit.

9. The drilling riser of claim 1, further comprising a tether line to be disposed only when the upper section is to be decoupled from the lower section, wherein the tether line is configured to restrain the lower section in a freestanding position from significant upward movement but not to restrain the drilling riser in operation.

10. The drilling riser of claim 1, further comprising a stabilizing device including a plurality of mooring lines connected to the lower section proximate an upper end of the lower section.

11. The drilling riser of claim 1, further comprising a stabilizing device including a trussed frame disposed around the lower section of the drilling riser.

12. A method of manufacturing a drilling riser for subsea drilling, the method comprising:

fabricating an upper section of the drilling riser comprising an upper conduit for conveying drilling material;

fabricating a lower section of the drilling riser comprising a lower conduit for conveying drilling material, the lower section configured to couple via a connector to the upper section of the drilling riser;

determining an amount of passive buoyant material to dispose on the lower section such that the lower section is positively buoyant and the drilling riser is neutrally or negatively buoyant; and disposing the buoyant material on the lower section such that the buoyant material is distributed along a substantial length of the lower section and provides substantially constant buoyancy over time.

13. The method of claim 12, wherein determining the amount of buoyant material comprises determining the length of the buoyant material to be disposed on the lower section and a diameter of the buoyant material.

14. The method of claim 13, wherein the length to diameter (L/D) ratio of the buoyant material is greater than 5.

15. The method of claim 12, wherein disposing the buoyant material on the lower section comprises disposing the buoyant material on a first linear length of the lower section proximate the upper section but not on a second linear length of the lower section proximate a subsea wellhead.

16. The method of claim 15, wherein a ratio of the first linear length to the second linear length is at least 0.5.

17. The method of claim 16, wherein the ratio of the first linear length to the second linear length is at least 1.

18. The method of claim 15, wherein the buoyant material covers at least 80 percent of the first linear length of the conduit.

19. A method of operating a drilling riser, the method comprising:

conveying drilling material through a conduit of a lower section and a conduit of an upper section of the drilling riser, the lower section coupled to a subsea wellhead and the upper section coupled to a drilling vessel;

suspending drilling operations and shutting in the subsea wellhead;

decoupling the upper section of the drilling riser from the lower section of the drilling riser;

relocating the drilling vessel and the upper section of the drilling riser;

leaving the lower section of the drilling riser coupled to the subsea wellhead, wherein the lower section comprises a buoyant material that is distributed and passive over a substantial length of the lower section such that the buoyant material of the lower section provides for substantially constant buoyancy over time and the lower section to be positively buoyant when decoupled from the upper section and coupled to the wellhead and the drilling riser to be neutrally buoyant or negatively buoyant when coupled to the upper section.

20. The method of claim 19, comprising controlling the stability of the drilling riser via tensioners of the drilling vessel.

21. The method of claim 19, wherein decoupling the upper section from the lower section comprises disconnecting via a connector disposed between the upper section and the lower section.

22. The method of claim 19, wherein relocating the drilling vessel comprises relocating the drilling vessel and the upper section away from the subsea wellhead to outside of a path of an adverse environmental condition that could impose a load on the drilling vessel in excess of station-keeping capacity.

23. The method of claim 19, wherein the lower section comprises a submerged weight of −120,000 kgf or less.

24. The method of claim 19, further comprising installing a tether line on the lower section to restrain the lower section from upward movement in the event of failure when decoupled from the upper section.

25. The method of claim 24, wherein installing the tether line comprises coupling one end of the tether line to an anchor or deadweight, and coupling another end of the tether line to the lower section.

26. The method of claim 19, further comprising installing a stabilizing device for the lower section to restrain lateral movement of the lower section when decoupled from the upper section.

* * * * *